US008069959B2

(12) United States Patent
Oh et al.

(10) Patent No.: US 8,069,959 B2
(45) Date of Patent: Dec. 6, 2011

(54) ELEVATOR ACTIVE SUSPENSION UTILIZING RESPULSIVE MAGNETIC FORCE

(75) Inventors: Jae-Hyuk Oh, Tolland, CT (US); Pei-Yuan Peng, Ellington, CT (US); Howard Winston, Woodbury, CT (US); Alan Finn, Hebron, CT (US)

(73) Assignee: Otis Elevator Company, Farmington, CT (US)

( * ) Notice: Subject to any disclaimer, the term of this patent is extended or adjusted under 35 U.S.C. 154(b) by 1056 days.

(21) Appl. No.: 10/561,559

(22) PCT Filed: Jun. 20, 2003

(86) PCT No.: PCT/US03/19501

§ 371 (c)(1),
(2), (4) Date: Dec. 19, 2005

(87) PCT Pub. No.: WO2005/007549

PCT Pub. Date: Jan. 27, 2005

(65) Prior Publication Data

US 2006/0175150 A1 Aug. 10, 2006

(51) Int. Cl.
*B66B 7/04* (2006.01)
*B66B 1/34* (2006.01)
*B66B 11/02* (2006.01)

(52) U.S. Cl. ..... 187/409; 187/292; 187/393; 187/401

(58) Field of Classification Search ..... 187/284, 187/292, 393, 401, 409, 414; *B66B 7/04, B66B 11/02*

See application file for complete search history.

(56) References Cited

U.S. PATENT DOCUMENTS

| | | | | |
|---|---|---|---|---|
| 4,838,172 | A * | 6/1989 | Morishita et al. | 104/281 |
| 5,141,082 | A | 8/1992 | Ishii | |
| 5,308,938 | A * | 5/1994 | Roberts et al. | 187/393 |
| 5,368,132 | A | 11/1994 | Hollowell | |
| 5,810,120 | A | 9/1998 | Jamieson | |
| 5,864,102 | A * | 1/1999 | Jamieson et al. | 187/292 |
| 6,305,502 | B1 * | 10/2001 | He et al. | 187/292 |
| 6,510,925 | B1 | 1/2003 | DeJong | |
| 2002/0017434 | A1 | 2/2002 | Orrman et al. | |
| 2008/0110701 | A1 * | 5/2008 | Ito et al. | 187/292 |
| 2009/0103227 | A1 * | 4/2009 | Morishita | 361/144 |

FOREIGN PATENT DOCUMENTS

| | | | |
|---|---|---|---|
| EP | 1262439 | A2 * | 12/2002 |
| EP | 1 067 083 | B1 | 3/2005 |
| JP | 01156293 | A * | 6/1989 |
| JP | 7-215634 | A | 8/1995 |
| JP | 10245178 | A * | 9/1998 |
| JP | 10245179 | A * | 9/1998 |

OTHER PUBLICATIONS

Int'l Search Report, dated Oct. 8, 2003.

* cited by examiner

*Primary Examiner* — Michael Mansen
*Assistant Examiner* — Stefan Kruer
(74) *Attorney, Agent, or Firm* — Carlson, Gaskey & Olds PC

(57) ABSTRACT

An elevator includes a car follower associated with each of a pair of guide rails, and carrying electromagnets which are spaced from electromagnets on an elevator car. The electromagnets on the car and car follower create a repulsive force tending to center the car between the car follower electromagnets associated with the two guide rails. Preferably, the car follower electromagnets are interconnected into a single car follower such that they move together.

4 Claims, 3 Drawing Sheets

ELEVATOR ACTIVE SUSPENSION UTILIZING RESPULSIVE MAGNETIC FORCE

BACKGROUND OF THE INVENTION

This application relates to an elevator car having lateral suspension provided by electromagnets mounted on the car and a car follower to create a repulsive magnetic force. Preferably, the car follower has a pair of electromagnets which are interconnected to move together.

Elevator cars are typically guided for movement upwardly and downwardly by passive suspension systems including spring biased rollers moving along rails. One challenge faced by elevator designers is the control of lateral vibration. Any vibrations that occur as the car moves laterally reduce the ride quality, which is undesirable.

One problem with addressing lateral vibrations is that the vibrations occur across a range of frequencies. Fully addressing these vibrations is not possible with typical passive suspension systems. In particular, to address low frequency vibration, a high spring stiffness for the passive suspension would be necessary. On the other hand, a high spring stiffness would not address the high frequency vibration, which would require a lower spring stiffness. Thus, passive suspension systems have not been able to address a wide band of vibration frequencies.

It has been proposed to utilize magnetic suspension members in combination with these passive suspensions. These combined systems have not always been fully acceptable either. Moreover, these systems have a resultant noise which would be undesirable.

Other suspensions rely solely upon magnetic suspension elements. These suspension elements have typically used an attractive magnetic force. That is, a steel rail is provided, and an electromagnet is provided on the car. The electromagnet is attracted to the steel rail. An electromagnet and guide rail are associated with each side of the car. Thus, in an idealized situation, two opposed attractive forces center the car between the two rails. However, in practice, this system would actually be unstable. Should the car move slightly toward either side, which would be the natural effect of an additional lateral force, then the system would become quickly unstable. In particular, the attractive force between the rail and the electromagnet is proportional to the inverse of the square of the distance. As the car moves closer to one of the two rails, the attractive force would also increase. Thus, should the car move closer to one rail, the attractive force pulling the car further toward that rail would also begin to overcome the attractive force pulling the car toward the other rail. One other problem with this type of system is poor controllability. There could be a good deal of power loss in the steel rail, and current saturation. Further, the shape of the rail would make controllability difficult.

A system disclosed in U.S. Pat. No. 6,510,925 would rely upon repulsive magnetic forces. A repulsive magnetic force would have the opposite correction to an attractive magnetic force, and would thus tend to center a car.

The system disclosed in U.S. Pat. No. 6,510,925 has a separate car follower associated with each of the two guide rails. These car followers are connected through springs to the car. Thus, the car followers are not free to move relative to the car, and are each independent of the other. These facts would make it more difficult to control the lateral vibration, and could, in fact, cause additional lateral and even vertical vibrations.

SUMMARY OF THE INVENTION

In a disclosed embodiment of this invention, a car follower portion having an electromagnet faces an electromagnet associated with the car at each of a pair of guide rails. A repulsive force is created between the electromagnets on the car follower portion and the car. The electromagnets can be better controlled than permanent magnets. A control can adjust the field strength of the electromagnets to control the magnitude of the repulsive force. Thus, the use of electromagnets associated with both of the follower portions and the car provides benefits over the prior art.

In another feature, and in the preferred embodiment, the car follower portions associated with the two guide rails are interconnected into a single car follower. The car follower is able to move relative to the car in the horizontal plane which is perpendicular to the axis of movement of the car. However, the car follower does move with the car along the direction of travel. The car follower is guided along both rails. Should there be a lateral vibration, the repulsive force between the car follower and the car will ensure that this force will be dampened or reduced. A more standard, or even rigid, guide can be used between the guide rails and the car follower. While the feature of the single car follower is preferably utilized with electromagnets, it can also provide benefits when used with permanent magnets.

These and other features of this invention can be best understood from the following specification and drawings, the following of which is a brief description.

DETAILED DESCRIPTION OF THE PREFERRED EMBODIMENTS

Figure 1:
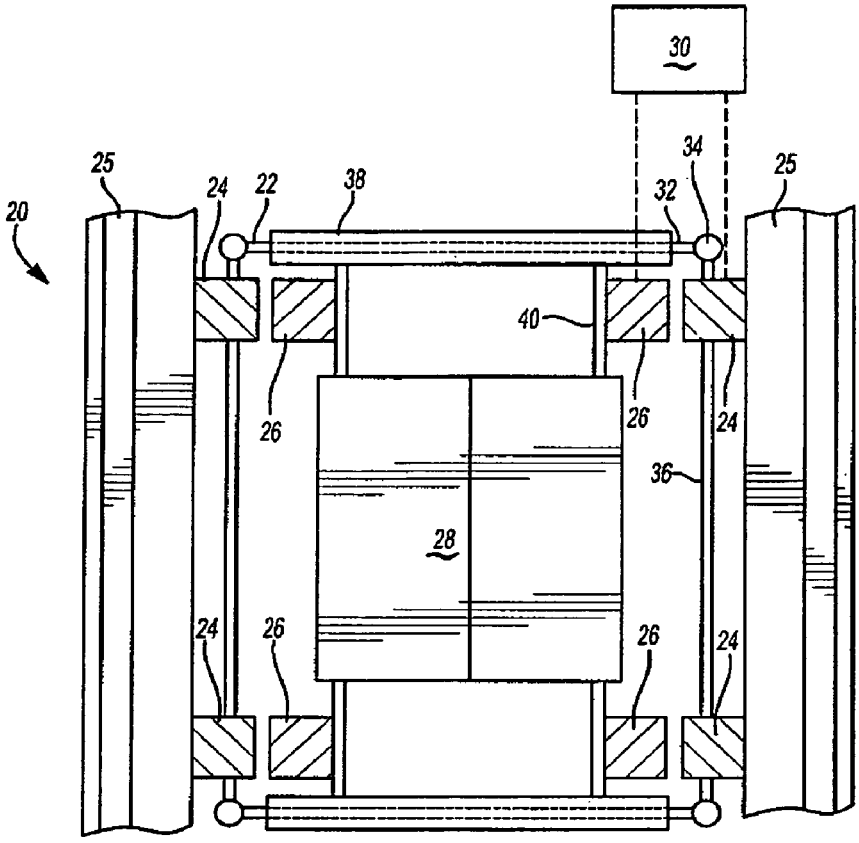
FIG. 1 is a schematic view of an embodiment.
Figure 2:
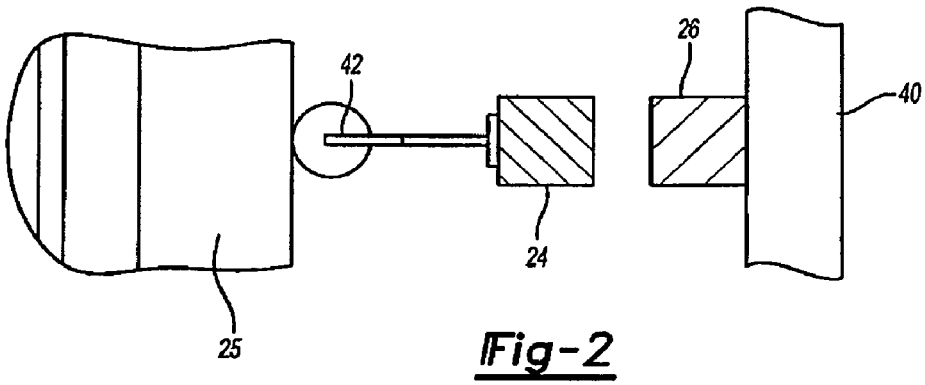
FIG. 2 schematically shows a feature of the FIG. 1 embodiment

FIG. 1 shows an elevator system 20 according to an example embodiment of this invention wherein a car follower 22 carries electromagnets 24 associated with vertically upper and lower positions, and with each lateral side of the car follower. For purposes of this application, the lateral sides of the car follower are referred to as two car follower portions. Of course, as discussed, in fact there is a single car follower, with these two "portions" being connected together. The electromagnets 24 are spaced in opposed relationships to electromagnets 26 fixed to an elevator car 28. The electromagnets 24 move along guide rails 25 as the car 28 moves up or down. Control 30 communicates with each of the electromagnets 24 and 26 and can control the field strength delivered by the electromagnets. The electromagnets in the opposed sets 24 and 26 create a repulsive magnetic force tending to center the car 28 between the opposed lateral sides of the car follower 22, and hence between the guide rails 25.

The car follower 22 includes a horizontally extending crossing member 32 connected at a universal joint 34 to a vertically extending member 36. The electromagnets 24 are mounted on the vertically extending member 36.

Figure 3:
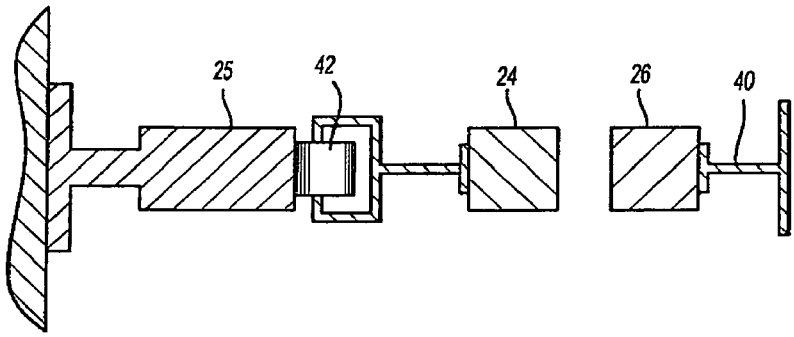
FIG. 3 is a view normal to the view of FIG. 2.

The electromagnets 24 sit opposed to an electromagnet 26 mounted on a vertically extending bar 40 associated with the car 28. As shown in FIG. 1, bars 40 connect the car 28 to a guide member 38. As can be seen in the embodiment shown in FIG. 3, the bars 40 may be I-beam shaped. Turning back to FIG. 1, the crossing members 32 extend through the guide member 38, as will be better understood below.

The electromagnets 24 sit opposed to an electromagnet 26 mounted on a vertically extending bar 40 associated with the car 28. As shown in FIG. 1, bars 40 connect the car 28 to a guide member 38. The crossing members 32 extend through the guide member 38, as will be better understood below.

Figure 4:
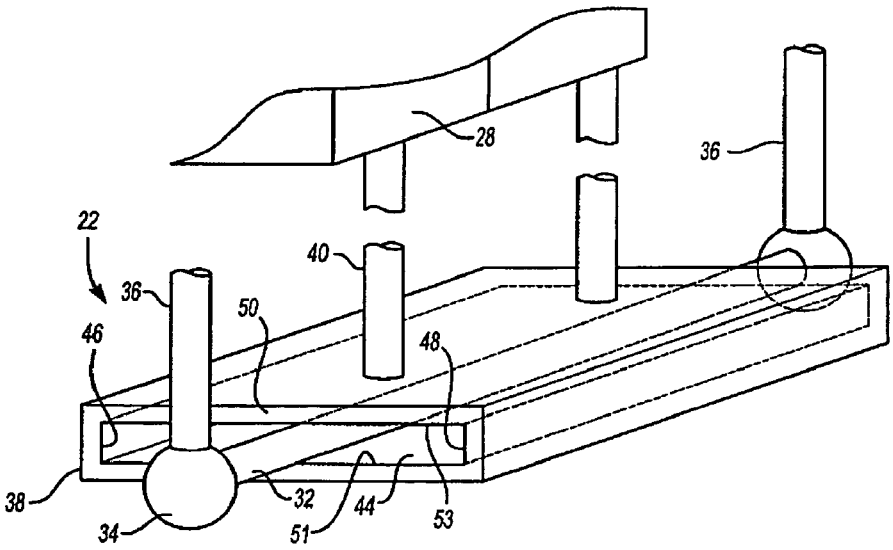
FIG. 4 is a detail of one feature of the FIG. 1 embodiment.

FIG. 4 shows details of the guide member 38 and car follower 22. The crossing member 32 extends through a slot 44 or space in the guide member 38. While there is some small clearance between the crossing member 32 and the vertical distance between walls 51 and 53, there is only a slight clearance. Thus, the crossing member 32 and hence the entire car follower 22 will tend to move vertically with the car 28. Further, the slot extends between side walls 46 and 48 within the guide member 38. The crossing members 32 are free to move a good deal within guide member 38 between these two side walls 46 and 48. Further, the crossing member 32 is free to move further inwardly and outwardly of the slot 44 within limits generally defined by the vertically extending members 36. That is, the crossing member 32 could move generally to the right and upwardly as shown in the perspective of FIG. 4 until the vertically extending member 36 abuts an end wall 50 of the guide member 38. Thus, it is clear that the crossing member 32, and hence the car follower 22 is free to move in a plane which is generally horizontal relative to the car, within the limits as described above. As can also be seen in FIG. 4 the bars 40 could alternatively be cylindrically shaped.

While it is perhaps easier to visualize movement of car follower 22, in fact, it would probably be more accurate to state that during operation, the car 28 is free to move relative to the car follower 22. The car follower 22 would tend to be guided between the guide rails 25 and thus the adjustment due to the repulsive force on the electromagnets 24 and 26 will likely cause the car 28 to move laterally between the car follower electromagnets 24.

Figure 5:
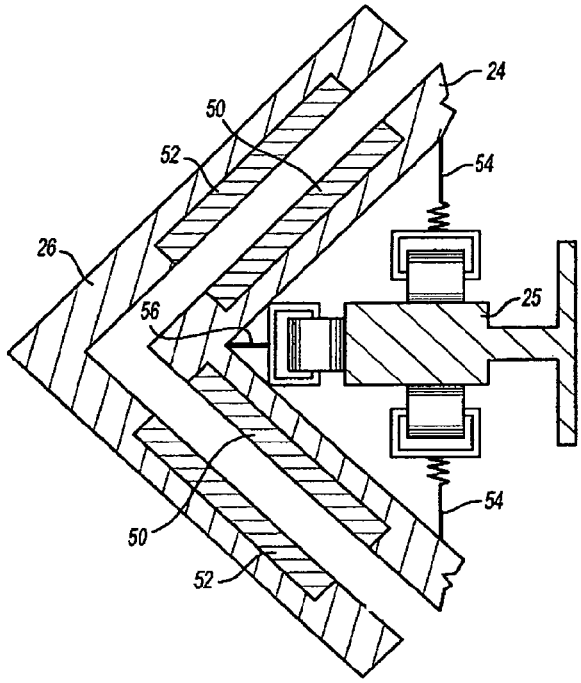
FIG. 5 shows a first embodiment mount for the FIG. 1 embodiment.

FIG. 5 shows a first possible embodiment of the magnetic guide structure for each of the rails. As shown, the electromagnet 26 actually includes a pair of electromagnets 52 facing electromagnets 50 on the car follower 22. As can be appreciated, there is a repulsive force between the electromagnets 50 and 52 which tends to reduce any effect of lateral vibration between the car follower and the car. The car follower 22 includes spring biased guide rollers 54 and a guide roller 56 without a spring, movable along rail 25. The structure and operation of the roller guides, including their spring bias is as known in the art, and is shown very schematically in FIG. 5.

Figure 6:
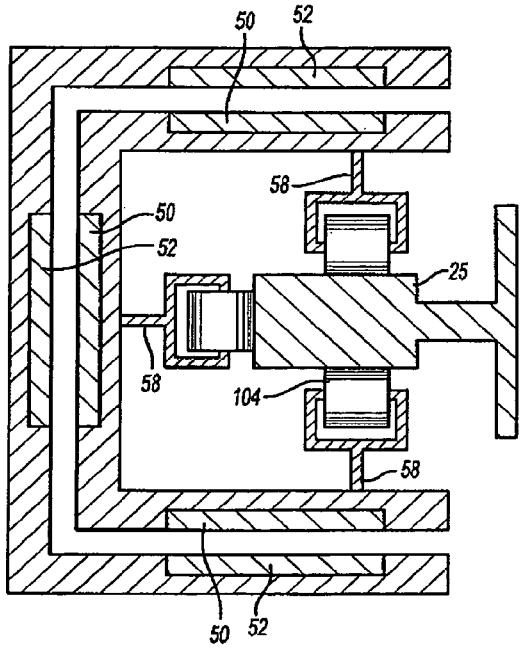
FIG. 6 shows a second embodiment mount.

FIG. 6 shows an embodiment wherein there is less space for the guide structure. In this embodiment, there are three electromagnets 50 associated with the car follower. Guide rollers 58 which may be spring biased, ride along the guide rail 25.

With the present invention, a repulsive force is provided and maintained between the electromagnets associated with the car and the car follower. As a lateral vibration affects either the car follower or the car, the repulsive magnetic force would tend to center the car between the opposed rails. In this way, lateral vibrations will not affect the ride quality for the elevator car.

The control shown schematically at 30 in FIG. 1 can sense the amount of force needed at any point, and can control the field strength of the electromagnets to in turn control the magnitude of the repulsive force. This provides valuable benefits, and identifies another reason why the use of electromagnets is an improvement over the prior art permanent magnets. Also, the control may be provided with feedback such as car speed and load, and can vary the magnitude of the repulsive force based upon the speed and load as appropriate. How the elevator designer would like to vary the control may differ with the specific application. However, the present invention provides a way to allow such variation. How one would sense vibration, speed or other variables to determine appropriate control would be within the level of skill in the art.

Although a preferred embodiment of this invention has been disclosed, a person of ordinary skill in this art would recognize that certain modifications would come within the scope of this invention. For that reason, the following claims should be studied to determine the true scope and content of this invention.

The invention claimed is:

1. An elevator system comprising:

a car (28) having a plurality of opposed electromagnets (26); and two spaced car follower portions 40 each having an electromagnet 24 facing a corresponding one of said electromagnets on said car, and said car follower portions each being provided with guide structure (42) for moving along a guide rail (25) in an elevator hoistway, said electromagnets on said car and said car follower portions interacting to provide a repulsive force tending to force said elevator car to be centered between said car follower portions wherein said car follower portions are interconnected (32) to move together as a single car follower wherein said car is free to move relative to said car follower in a horizontal plane but constrained to move with said car follower in a vertical direction wherein said car follower is movable relative to a guide member (38) which moves with said car, said car follower including crossing members (32) extending through a slot (44) in said guide member, said guide member ensuring that said car is constrained to move with said car follower in said vertical direction.

2. An elevator system as set forth in claim 1, wherein said car follower includes generally vertical extending frame members (36) which are connected to said crossing members (32) through a universal joint (34).

3. An elevator comprising:

a car (28) to be movable through a vertical path of travel; and a car follower (22) to be movable along two guide rails (25), said car follower including magnets (24) associated with each guide rail, said magnets on said car follower interconnected (32) to move together in a horizontal plane and relative to said car, and said car including magnets (26) positioned to be opposed to said magnets on said car follower, said car being free to move relative to said car follower in a horizontal plane, but generally constrained to move with said car follower along said vertical path of travel, and there being a repulsive magnetic force between said magnets on said car follower and said magnets on said car wherein said car follower is movable relative to a guide member (38) which moves with said car, said car follower including crossing members (32) extending through a slot (44) in said guide member, and said crossing members being received in said slot ensuring that said car is constrained to move with said car follower in said vertical direction.

4. An elevator as set forth in claim 3, wherein said car follower includes generally vertically extending frame members (36) which are connected to said crossing members (32) through a universal joint (34).

* * * * *